US005927873A

United States Patent [19]

Siwinski

[11] Patent Number: 5,927,873

[45] **Date of Patent: *Jul. 27, 1999**

[54] PRINTER DEFINING A REDUCED EXTERIOR ENVELOPE THEREOF AND METHOD OF PROVIDING SAME

[75] Inventor: Michael J. Siwinski, Rochester, N.Y.

[73] Assignee: Eastman Kodak Company, Rochster, N.Y.

[ * ] Notice: This patent is subject to a terminal disclaimer.

[21] Appl. No.: 08/938,915

[22] Filed: Sep. 26, 1997

[51] Int. Cl.[6] ..... B14J 35/28

[52] U.S. Cl. ..... 400/120.01; 400/208; 400/207

[58] Field of Search ..... 400/208, 120.01, 400/208.1, 207

[56] References Cited

U.S. PATENT DOCUMENTS

| | | | |
|---|---|---|---|
| 5,005,998 | 4/1991 | Takanashi et al. | 400/208 |
| 5,277,502 | 1/1994 | Kim | 400/196 |
| 5,597,249 | 1/1997 | Mistyurik | 400/207 |

FOREIGN PATENT DOCUMENTS

| | | | |
|---|---|---|---|
| 3939886 | 8/1990 | Germany | 400/208 |
| 62-187060 | 12/1986 | Japan | 400/208 |

OTHER PUBLICATIONS

Belave et al., "Printer Defining a Reduced Exterior Envelope Thereof and Method of Providing Same", U.S. application No. 08/944,348, (Attorney Docket No. 76546), filed Oct. 6, 1997.

Siwinski, "Dye Cartridge Adapted to Reduce An Exterior Envelope of a Printer and Method of Providing Same", U.S. application No. 08/938,868, (Attorney Docket No. 76607), filed Sep. 26, 1997.

*Primary Examiner*—Edgar Burr
*Assistant Examiner*—Daniel J. Colilla
*Attorney, Agent, or Firm*—Walter S. Stevens

[57] ABSTRACT

Printer defining a reduced exterior envelope thereof and method of providing same. In one embodiment of the invention, a print head is movable from a first position spaced-apart from the platen to a second position adjacent the platen, such that the platen and the print head define a clearance therebetween when the print head is in the first position. A dye donor cartridge, which has an elongate neck portion defining a longitudinal axis therealong, is insertable through the aperture and into the housing to a position adjacent the print head. The neck portion is sized to be received through the clearance for interference-free insertion of the cartridge. Moreover, the cartridge includes a dye donor take-up spool that has an elliptically-shaped transverse cross section defining a major axis and is capable of being oriented such that the major axis of the take-up spool is parallel with the longitudinal axis of the neck portion. When the major axis is parallel with the longitudinal axis, the elliptically-shaped take-up spool allows the neck portion, including its take-up spool, to be inserted through the clearance so that they do not create an interference with the print head.

15 Claims, 5 Drawing Sheets

PRINTER DEFINING A REDUCED EXTERIOR ENVELOPE THEREOF AND METHOD OF PROVIDING SAME

FIELD OF THE INVENTION

This invention generally relates to printer apparatus and methods and more particularly relates to a printer defining a reduced exterior envelope thereof and method of providing same.

BACKGROUND OF THE INVENTION

A typical thermal printer has an enclosure for enclosing the components of the printer. Receiver medium is held in a supply tray at least partially insertable into the enclosure for supplying the receiver medium to a print head housed in the enclosure. A "picker" mechanism engages the receiver medium held in the supply tray and feeds the receiver medium to the print head. The receiver medium fed to the print head is brought into contact with a dye donor web carried by a dye donor cassette also insertable into the enclosure, the cassette capable of being disposed near the print head. The print head heat activates the dye donor web to transfer the dye to the receiver medium in order to print an output image on the receiver medium. The enclosure and the supply tray define an exterior envelope of the printer.

The dye donor cassette is usually inserted into the printer by opening a top panel of the printer and lowering the dye donor cassette into position in the printer. However, such printers are often placed in a confined space with limited head room. For example, such printers are often placed on shelves, wherein the floor of an adjacent upper shelf forms a relatively low ceiling above the top panel of the printer. Thus, this ceiling creates an interference or obstruction to opening the top panel. This makes loading the dye donor cassette difficult and time-consuming because the printer first must be removed from the shelf in order to open the top panel before loading the dye donor cassette into the printer. Therefore, it would be desirable to provide a printer obviating the need to open the top panel in order to load the dye donor cassette.

Front loading printers are known. A compact printer body capable of accepting an ink film and printing papers device into a receiving hole provided at the front face of the printer body is disclosed in U.S. Pat. No. 5,277,502 titled "Device For Loading Ink Film And Printing Papers In Color Video Printer" issued Jan. 11, 1994 in the name of Jae S. Kim. More specifically, this patent discloses a device having combined ink film and printing papers therein for combined loading of the ink film and printing papers into the color video printer. According to this patent, the device achieves a reduced size and thus results in compactness of the printer body. However, this combined ink film and printing papers device does not appear suitable for use where it is desired to feed printing papers and ink film independently and separately into the printer.

Therefore, there has been a long-felt need to provide a suitable printer that obviates the need to load the dye donor cartridge by opening the top panel of the printer.

SUMMARY OF THE INVENTION

The invention resides in a printer having a reduced exterior envelope. The printer comprises a housing having a front sidewall which in turn has an aperture therethrough. A platen is disposed in the housing. A print head, which may be a thermal print head, is also disposed in the housing. The print head is movable from a first position spaced-apart from the platen to a second position adjacent the platen. Thus, the platen and the print head will define a clearance therebetween when the print head is in the first position. The movement of the print head is accomplished by means of a movable arm connected to the print head for moving the print head from the first position to the second position.

A dye donor cartridge is insertable through the aperture and into the housing to a position adjacent the print head. The cartridge has an elongate neck portion defining a longitudinal axis therealong and is sized to be received through the clearance for interference-free insertion of the cartridge between the print head and the platen. Moreover, the cartridge includes a supply spool at one end of the cartridge for engaging a first end portion of a dye donor ribbon carried by the cartridge and which extends through the neck portion. A take-up spool is disposed at another end of the cartridge in the neck portion for engaging a second end portion of the dye donor ribbon. The take-up spool itself has an elliptically-shaped transverse cross section defining a major axis and is capable of being oriented such that the major axis of the take-up spool is parallel with the longitudinal axis of the neck portion. When the major axis is parallel with the longitudinal axis, the elliptically-shaped take-up spool, which is disposed in the neck portion, allows the neck portion, including its take-up spool, to be inserted through the clearance so that the neck portion and the take-up spool do not create an interference with the print head. A biasing mechanism is also provided for biasing the take-up spool in order to bring the major axis of the take-up spool parallel with the longitudinal axis of the neck portion as the neck portion is inserted through the clearance. In this manner, the cartridge can be loaded through the aperture in the front sidewall rather than by opening a top panel of the printer, so that the exterior envelope of the printer is reduced. This allows the printer to reside in a confined space with limited headroom.

An object of the present invention is to provide a printer defining a reduced exterior envelope thereof.

A feature of the present invention is the provision of a print head disposed in a housing having a front sidewall having an aperture, the print head being movable from a first position spaced-apart from the platen to a second position adjacent the platen, the platen and the print head defining a clearance therebetween when the print head is in the first position.

Another feature of the present invention is the provision of a cartridge having an elliptically-shaped take-up spool disposed in an elongate neck portion that is sized to be received through the clearance for interference-free insertion of the cartridge.

An advantage of the present invention is that the printer has a reduced exterior envelope resulting from the cartridge being loaded through the aperture in the front sidewall rather than by means of opening a top panel of the printer in order that the printer may reside in a confined space with limited headroom.

These and other objects, features and advantages of the present invention will become apparent to those skilled in the art upon a reading of the following detailed description when taken conjunction with the drawings wherein there is shown and described an illustrative embodiment of the invention.

BRIEF DESCRIPTION OF THE DRAWINGS

In the detailed description of the preferred embodiments of the invention presented hereinbelow, reference is made to the accompanying drawings, in which.

DETAILED DESCRIPTION OF THE INVENTION

The present invention is directed in particular to elements forming part of, or cooperating more directly with, apparatus in accordance with the present invention. It is to be understood that elements not specifically shown or described may take various forms well known to those skilled in the art.

Figure 1:
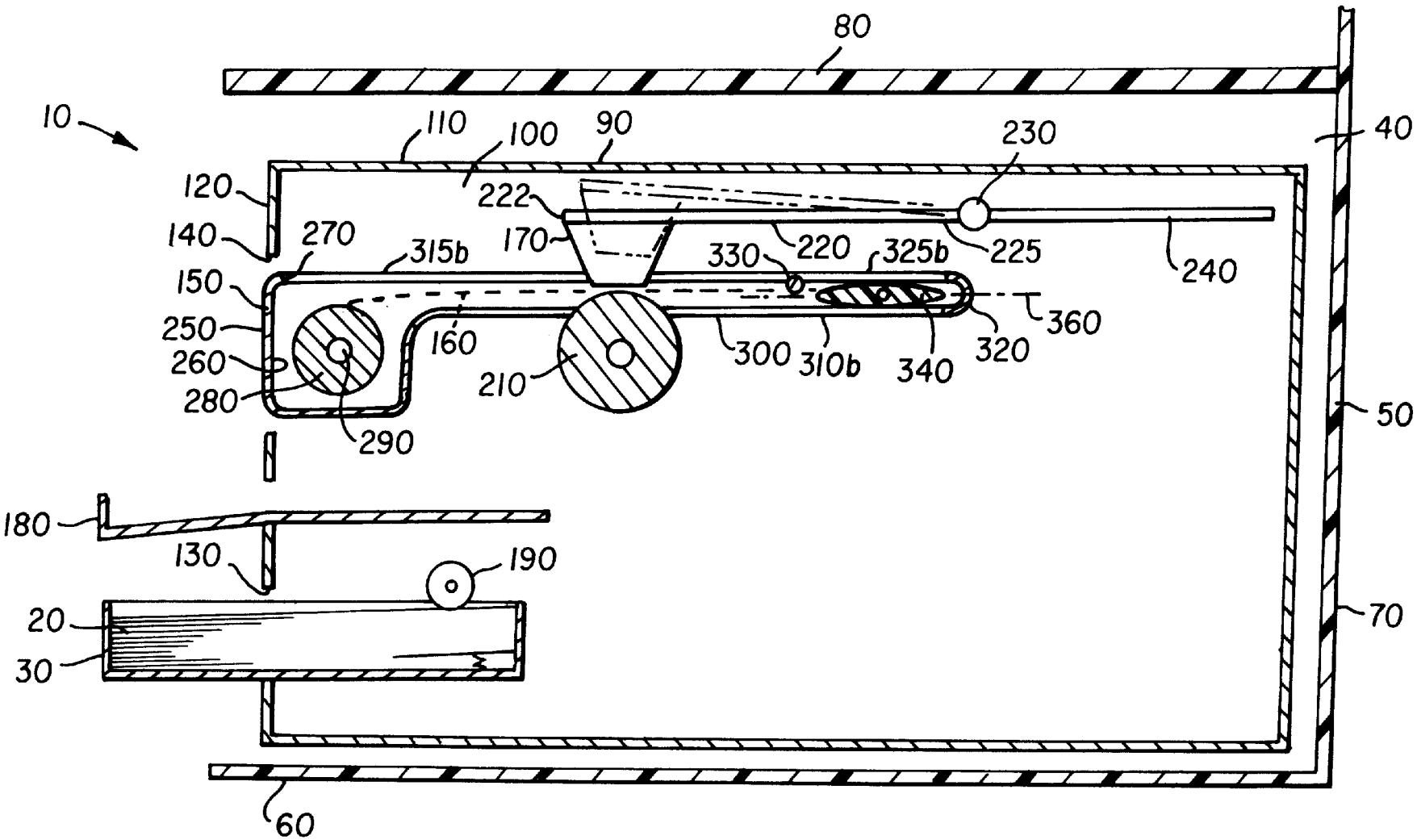
FIG. 1 is a view in elevation of a first embodiment thermal printer with parts removed for clarity, the printer having a housing defining a reduced exterior envelope thereof for disposing the printer in a confined space with limited headroom, this view also showing a cartridge carrying a dye donor ribbon and being inserted into the printer while the print head is in a first position spaced-apart from a platen disposed in the housing.

Therefore, referring to FIG. 1, there is shown a first embodiment of a printer, such as a thermal resistive printer, generally referred to as 10, for printing an image on a dye receiver 20, which receiver 20 may be a roll of receiver or a plurality of cut sheets of coated paper or transparency fed from a receiver medium supply tray 30. As described more fully hereinbelow, printer 10 has a reduced exterior envelope so that printer 10 may be placed in a confined space 40, such as defined by a shelf structure 50 bounded by a floor 60, a rear wall 70 and a relatively low ceiling 80 overhanging printer 10.

Referring again to FIG. 1, printer 10 comprises a housing 90 defining an exterior envelope thereabout and an interior 100 therein. Housing 90 includes a top wall 110 and a front sidewall 120, front sidewall 120 having an opening 130 sized to receive supply tray 30 which is at least partially insertable through opening 130. Also formed through front sidewall 120 is an aperture 140 for receiving a dye-carrying dye donor supply cartridge 150. In this regard, cartridge 150 carries a thermally activatable dye donor ribbon 160. Moreover, disposed in housing 90 is a thermal resistive print head 170 for thermally activating dye donor ribbon 160 in order to transfer dye therein onto each of sheets 20. In this regard, thermal print head 170 is formed of a plurality of individual resistive heating elements (not shown) such that when a particular heating element is energized, its heat causes dye from dye donor ribbon 160 to transfer to sheet 20 for forming an image thereon. Printer 10 may also include an output tray assembly 180 for receiving sheets 20 after the image is formed on each sheet 20. Moreover, a picker roller 190 is disposed in housing 90 for separately urging each sheet 20 into a gap or nip area 200 (see FIG. 2) defined between print head 170 and a platen 210, which platen 210 is also disposed in housing 90.

Figure 2:
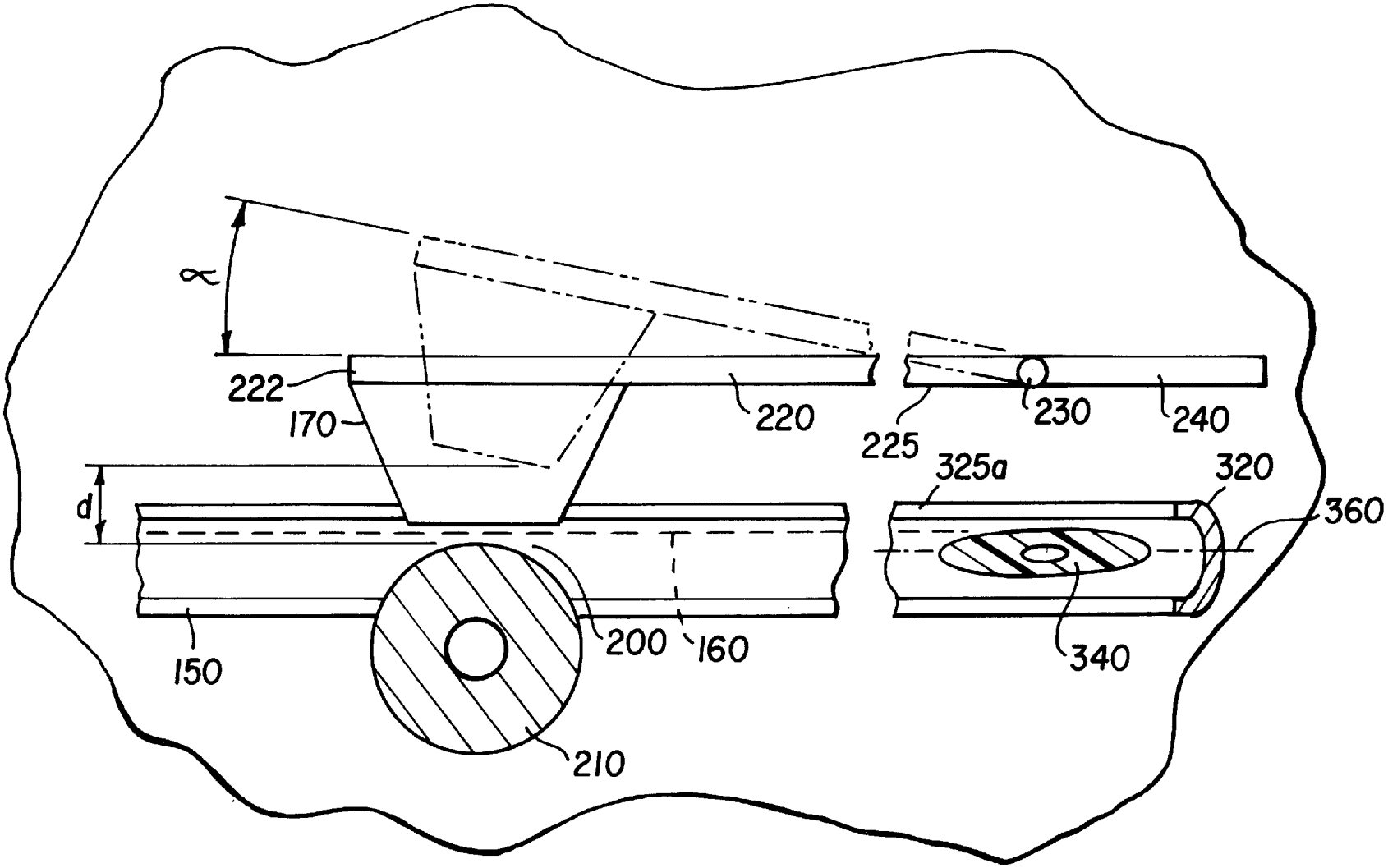
FIG. 2 is a fragmentation view in elevation of the printer showing a print head and the platen belonging to the printer, the print head being movable from the first position to a second position adjacent the platen.

Referring to FIGS. 1 and 2, printer 10 further comprises a movable arm 220 having a first end portion 222 connected to print head 170 and a second end portion 225 connected to a joint 230 interconnecting arm 220 to a stationary support member 240. Arm 220 is capable of pivoting about joint 230 through a predetermined angle "α" of approximately 10 degrees entirely within housing 90. As arm 220 pivots about joint 230, print head 170 moves from a first position spaced-apart from platen 210 to second position adjacent platen 210. In this regard, when print head 170 is in the first position thereof, print head 170 defines a clearance "d" between print head 170 and platen 210. Of course, this clearance "d" is substantially reduced when print head 170 moves to the second position thereof.

Referring now to FIGS. 2, 3, 4 and 5, cartridge 150, which is insertable through aperture 140 of front sidewall 120, includes an enlarged end portion 250 defining a chamber 260 therein in communication with an opening 270, for reasons disclosed hereinbelow. Disposed in chamber 260 is a cylindrical supply spool 280 surrounding a first axle 290 centered longitudinally through supply spool 280, which first axle 290 in turn is connected to a first motor (not shown) for rotating axle 290. Thus, supply spool 280 rotates as axle 290 rotates. Cartridge 150 further comprises an elongate neck portion 300 formed by a pair of spaced-apart parallel tines 310*a* and 310*b*, each tine 310*a*/310*b* having a first end portion 315*a* and 315*b*, respectively, integrally attached to enlarged portion 250. For reasons disclosed hereinbelow, cartridge 150 defines a longitudinal axis 317 centered between tines 310*a*/310*b*. If desired, an elongate guard shield 320 may interconnect second end portions 325*b* and 325*a* of tines 310*a*and 310*b*, respectively, for reasons provided hereinbelow. Moreover, an elongate dye donor ribbon guide pin 330 is disposed in neck portion 300 between enlarged end portion 250 and guard shield 320. Guide pin 330 extends between tines 310*a*/310*b*, for reasons disclosed more fully hereinbelow. In addition, interposed between tines 310*a*/*b* in neck portion 300 is a take-up spool 340 surrounding a second axle 350 which in turn is connected to a second motor (not shown) for rotating second axle 350. Thus, take-up spool 340 rotates as second axle 350 rotates. Preferably, the first motor causes supply spool 280 to rotate in a clockwise direction and the second motor causes take-up spool 340 also to rotate in a clockwise direction. The previously mentioned guard shield 320 protects take-up spool 340 from possible damage as cartridge 150 is inserted into housing 90. For reasons disclosed in more detail hereinbelow, second axle 350 terminates in a generally elliptically-shaped hub 355 integrally attached to second axle 350. Hub 355 is preferably disposed on the outboard side of tine 310*a*. However, hub 355 may be disposed on the outboard side of tine 310*b*, if desired. As previously mentioned, dye donor cartridge 150 carries thermally activatable dye donor ribbon 160. Therefore, it may be appreciated that a first end portion of dye donor ribbon 160 is necessarily attached to supply spool 280 and a second end portion of dye donor ribbon 160 is necessarily attached to take-up spool 340. Thus, the dye donor ribbon 160 is initially substantially wound about supply spool 280 and is subsequently unwound therefrom onto take-up spool 340 as the first and second motors operate.

Figure 3:
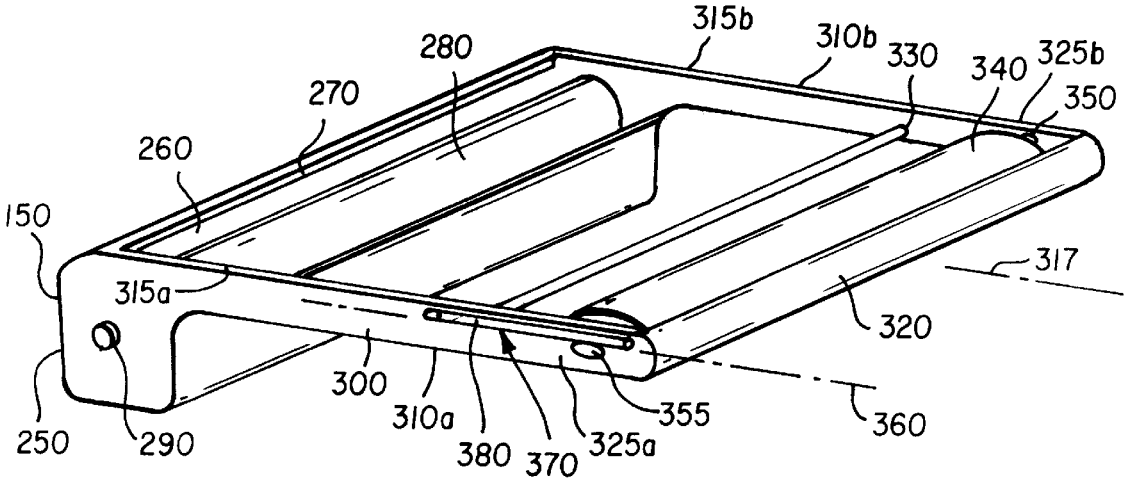
FIG. 3 is a view in perspective of the cartridge.

With reference to FIGS. 2 and 3, take-up spool 340 has a non-round generally "flattened" or elliptically-shaped transverse cross section defining a major axis 360. It is important that take-up spool 340 have an elliptically-shaped transverse cross section. This is important for the reasons provided immediately hereinbelow. That is, the elliptically-shaped transverse cross section provides take-up spool 340 with a minor axis that is substantially shorter than its major axis 360 (when take-up spool 340 is viewed in transverse cross section). Thus, take-up spool 340 is sized such that when major axis 360 is brought parallel to longitudinal axis 317 take-up spool 340 will assume a position within neck portion 300 such that no portion of take-up spool 340 extends beyond the edges of neck portion 300. This is so because angle "α" need not be increased to accommodate passage of both take-up spool 340 as well as neck portion 300. This in turn minimizes the previously mentioned angle "α" when neck portion 300 is inserted through clearance "d" to be positioned in nip 200. Again, this is true because no portion of take-up spool 340 extends beyond the edges of neck portion 300 when major axis 360 is parallel to longitudinal axis 317. Of course, minimizing angle "α" minimizes the clearance distance "d" through which print head 170 must be lifted in order to provide interference-free clearance for passage of neck portion 300. Minimizing the clearance distance "d" through which print head 170 must be lifted allows print head 170 to be lifted entirely within housing 90, thereby avoiding the need to open top wall 110 of housing 90. Thus, avoiding the need to open top wall 110 of housing 90 results from being able to load cartridge 150 through aperture 140 of front sidewall 120 (rather than loading cartridge 150 through top wall 110) in the manner described. This feature of the present invention allows printer 10 to be disposed in confined space 40 with limited headroom.

Figure 4:
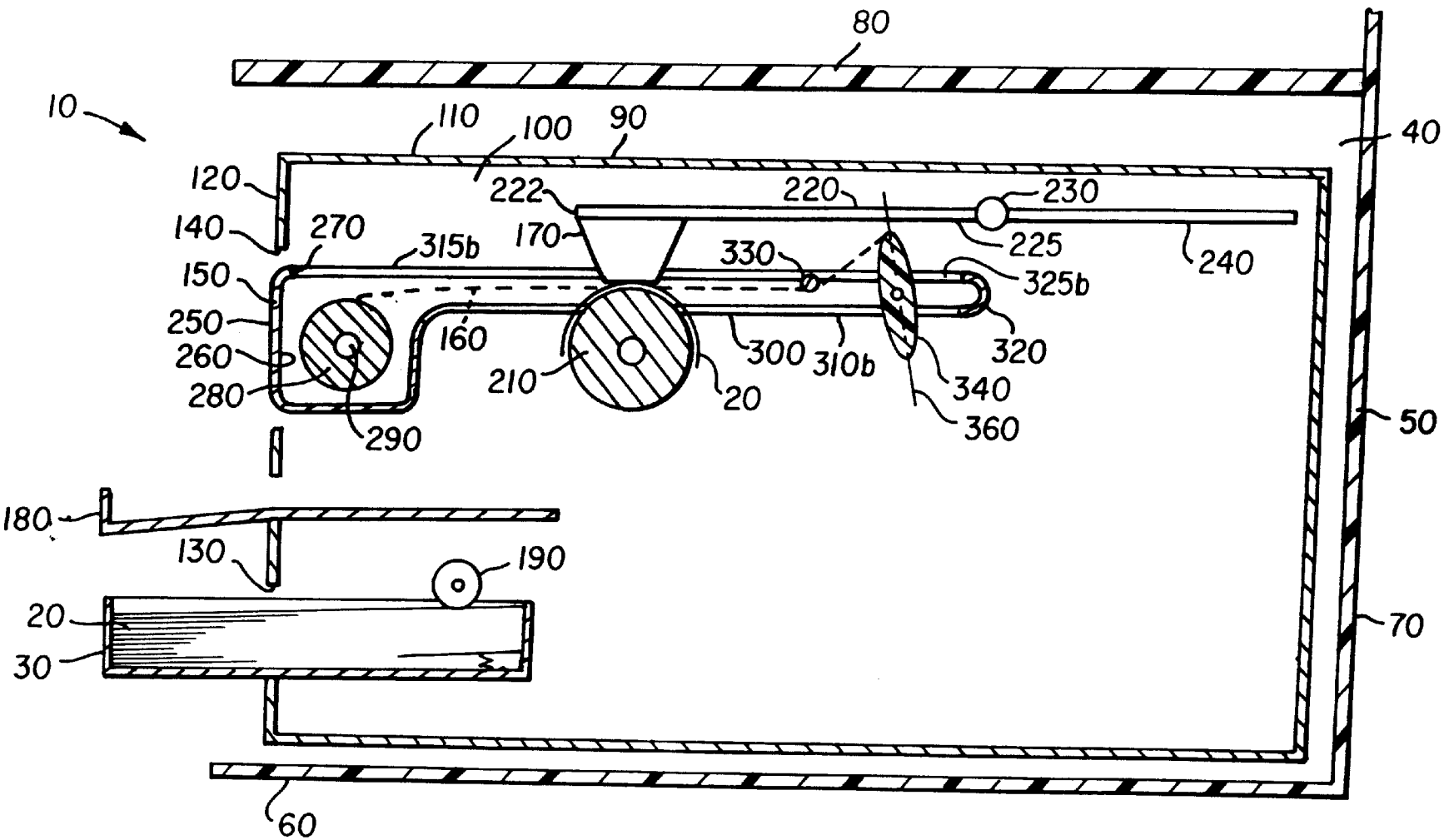
FIG. 4 is a view in elevation of the printer showing the print head in the second position thereof for thermally activating the dye donor ribbon.

As best seen in FIG. 4, once cartridge 150 is interposed between print head 170 and platen 210 in the manner disclosed hereinabove, print head 170 is moved, by any suitable means, to its second position and printing may commence. During the printing operation, in which print head 170 heats dye donor ribbon 160 to transfer dye therefrom onto receiver 20, take-up spool 340 rotates in order to "take-up" dye donor ribbon 160 being unwound from supply spool 280. Dye donor ribbon 160 slidably engages previously mentioned guide pin 330 in order to provide proper tensioning of ribbon 160 as take-up spool 340 "takes-up" ribbon 160.

Figure 5:
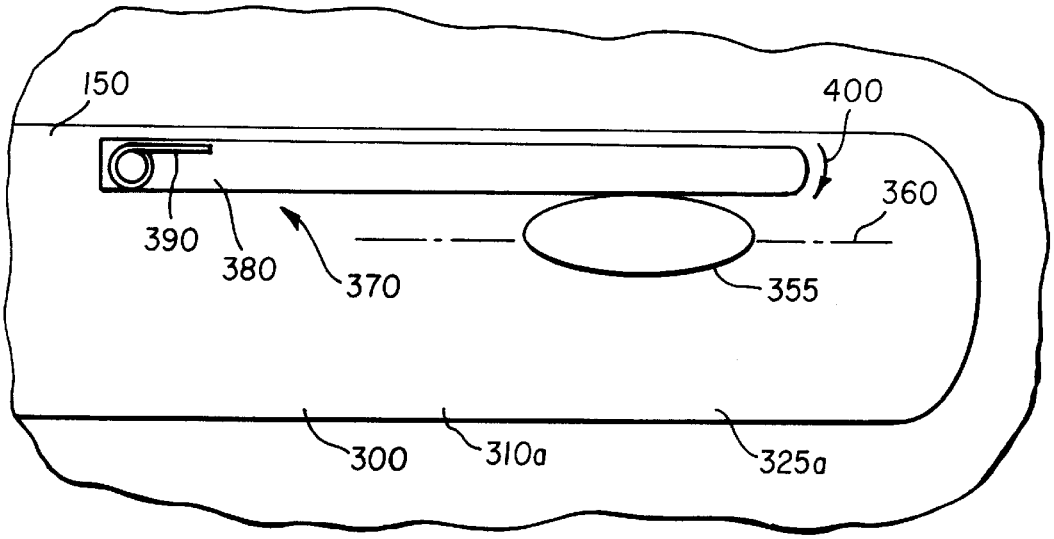
FIG. 5 is a fragmentation view in elevation of the cartridge showing a biasing mechanism biasing a take-up spool belonging to the cartridge so that the take-up spool is oriented in a preferred direction as the cartridge is inserted into the housing.

Referring now to FIGS. 3 and 5, a biasing mechanism, generally referred to as 370, may be provided for biasing take-up spool 340 so that major axis 360 thereof is oriented parallel with respect to longitudinal axis 317 when take-up spool 340 is not rotating (e.g., when neck portion is being inserted into clearance "d" prior to printing). In the preferred embodiment, biasing mechanism 370 comprises a tab member 380 connected either to tine 310*a* or 310*b*, as the case may be, by means of a coiled spring 390 which biases tab member 380 in the direction shown by a curved arrow 400. As tab member 380 is biased in the direction of arrow 400, it exerts a biasing force against the previously mentioned hub 355 so that hub 355 obtains a preferred direction (i.e., major axis 360 parallel to longitudinal axis 317) as neck portion 300 is being received into clearance "d". In this manner, take-up spool 340 will not interfere with print head 170, as previously mentioned.

Figure 6:
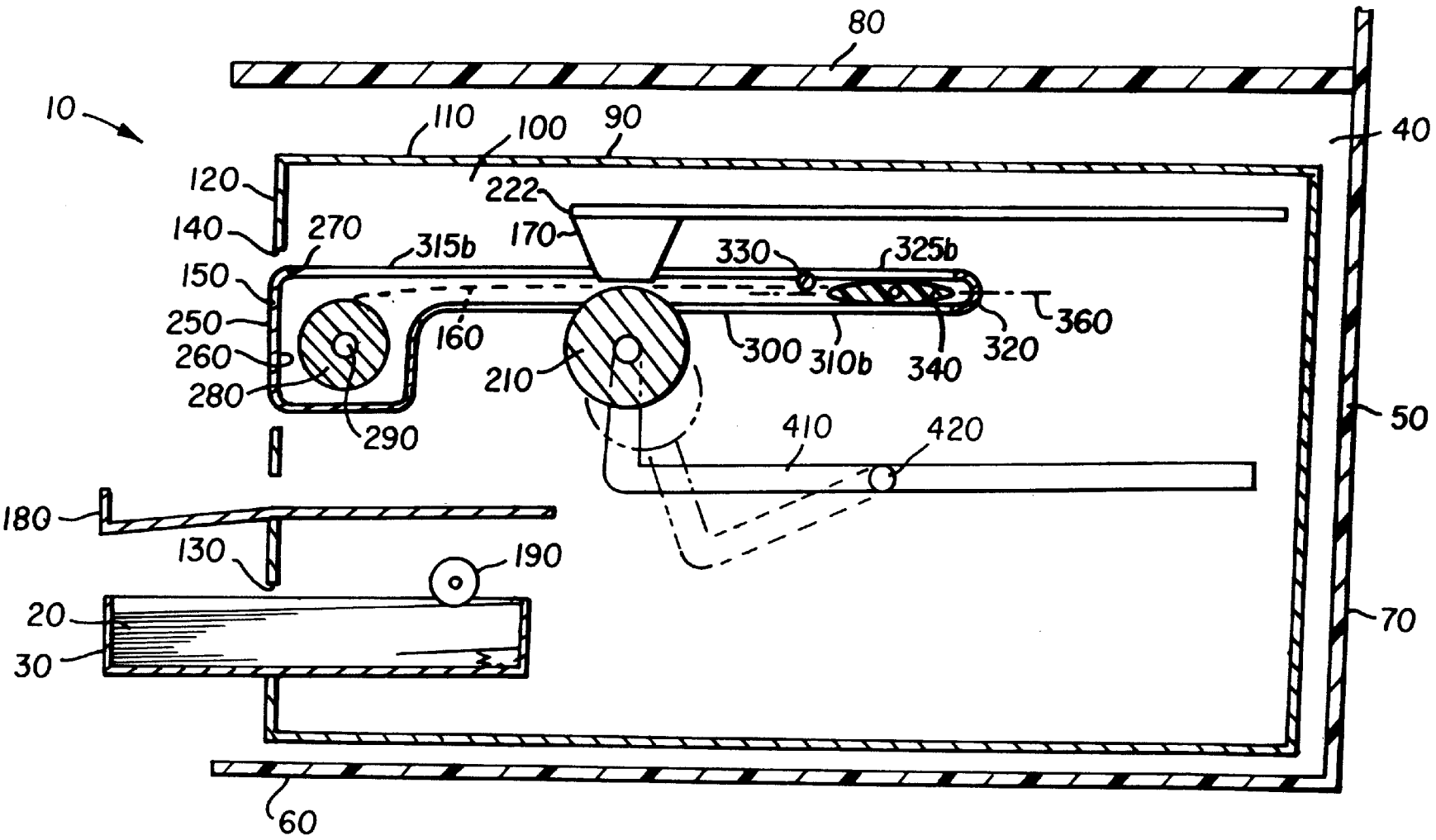
FIG. 6 is a view in elevation of a second embodiment thermal printer with parts removed for clarity, the printer having the housing defining the reduced exterior envelope thereof for disposing the printer in a confined space with limited headroom, this view also showing a cartridge carrying the dye donor ribbon and being inserted into the printer while the platen is in a first position spaced-apart from the print head disposed in the housing, the platen being movable from the first position to a second position adjacent the print head.

Referring to FIG. 6, there is shown a second embodiment of printer 10. In this second embodiment of printer 10, platen 210 is movable such as by means of pivoting arm 410, which is capable of pivoting about pivot point 420. When pivoting arm 410 pivots to a first position thereof spaced-apart from print head 170, it creates the previously mentioned clearance "d" between print head 170 and platen 210. Of course, this clearance "d" is substantially reduced when platen 210 moves to a second position thereof adjacent print head 170.

It may be appreciated from the teachings herein that an advantage of the present invention is that printer 10 has a reduced exterior envelope so that it can be disposed in confined space 40 which has limited headroom. This is so because dye donor cartridge 150 can be loaded, interference-free, into housing 90 through aperture 140 in front sidewall 120 rather than by opening a top panel of printer 10.

The invention has been described in detail with particular reference to certain preferred embodiments thereof, but it will be understood that variations and modifications can be effected within the spirit and scope of the invention. For example, supply spool 280 may also be provided with an elliptical transverse cross section similar to the elliptical transverse cross section of take-up spool 340. The advantage of providing both take-up spool 340 and supply spool 280 with an elliptical transverse cross section is that cartridge 150 will then assume a svelte almost entirely elongate profile for enhancing the aesthetic appearance thereof and for conserving space when a plurality of cartridges 150 are stacked in a storage area. As another example, unused portions of donor ribbon 160 could be wound on spool 340 while used portions of donor ribbon 160 could be wound onto spool 280, if desired.

Therefore, what is provided is a printer defining a reduced exterior envelope thereof and method of providing same.

PARTS LIST

"α" . . . angle
"d" . . . clearance
10 . . . printer
20 . . . dye receiver
30 . . . receiver medium supply tray
40 . . . confined space
50 . . . shelf structure
60 . . . floor
70 . . . rear wall
80 . . . ceiling
90 . . . housing
100 . . . interior
110 . . . top wall
120 . . . front sidewall
130 . . . opening
140 . . . aperture
150 . . . cartridge
160 . . . ribbon
170 . . . print head
180 . . . output tray
190 . . . picker roller
200 . . . nip
210 . . . platen
222 . . . first end portion
225 . . . second end portion
230 . . . joint
240 . . . support member
250 . . . enlarged end portion
260 . . . chamber
270 . . . opening
280 . . . supply spool
290 . . . first axle
300 . . . neck portion
310*a*/*b* . . . tines

315*a/b* . . . first end portions
317 . . . longitudinal axis
320 . . . guard shield
325*a/b* . . . second end portions
330 . . . guide pin
340 . . . take-up spool
350 . . . second axle
355 . . . hub
360 . . . major axis
370 . . . biasing mechanism
380 . . . tab member
390 . . . spring
400 . . . arrow
410 . . . pivoting arm
420 . . . pivoting point

What is claimed is:

1. A printer, comprising:

(a) a housing having a sidewall having an aperture, said housing defining an exterior envelope theresurrounding;

(b) a platen disposed in said housing;

(c) a print head disposed in said housing, said print head being movable from a first position spaced-apart from said platen to a second position adjacent said platen, said platen and said print head defining a clearance therebetween as said print head is in the first position;

(d) a dye cartridge insertable through the aperture and into said housing, said cartridge having an elongate neck portion sized to be received through the clearance for interference-free insertion of said cartridge into said housing, the neck portion defining a longitudinal axis therealong, said cartridge including:

(i) a supply spool for engaging a first end portion of a dye donor ribbon extending through the neck portion; and (ii) a take-up spool disposed in the neck portion for engaging a second end portion of the dye donor ribbon, said take-up spool having an elliptically-shaped transverse cross section defining a major axis thereof;

(e) a biasing mechanism associated with said take-up spool for biasing said take-up spool so that the major axis thereof is parallel with the longitudinal axis of the neck portion, said biasing mechanism including a spring member contacting said take-up spool; and (f) a movable arm connected to said print head for moving said print head from the first position to the second position, so that the exterior envelope surrounding said housing is unchanged.

2. The printer of claim 1, wherein said print head is a thermal print head.

3. A method of providing a printer, comprising the steps of:

(a) providing a housing having a sidewall having an aperture, the housing defining an exterior envelope theresurrounding;

(b) providing a platen disposed in the housing;

(c) providing a print head disposed in the housing, the print head being movable from a first position spaced-apart from the platen to a second position adjacent the platen, the platen and the print head defining a clearance therebetween as the print head is in the first position;

(d) providing a dye cartridge insertable through the aperture and into the housing, the cartridge having an elongate neck portion sized to be received through the clearance for interference-free insertion of the cartridge into the housing, the neck portion defining a longitudinal axis therealong, the step of providing a cartridge including the steps of:

(i) providing a supply spool for engaging a first end portion of a dye donor ribbon extending through the neck portion; and (ii) providing a take-up spool disposed in the neck portion for engaging a second end portion of the dye donor ribbon, the take-up spool having an elliptically-shaped transverse cross section defining a major axis thereof;

(e) providing a biasing mechanism associated with the take-up spool for biasing the take-up spool so that the major axis thereof is parallel with the longitudinal axis of the neck portion, the biasing mechanism including a spring member contacting the take-up spool; and (f) providing a movable arm connected to the print head for moving the print head from the first position to the second position, so that the exterior envelope surrounding said housing is unchanged.

4. The method of claim 3, wherein the step of providing a print head comprises the step of providing a thermal print head.

5. A printer, comprising:

(a) a housing having a sidewall having an aperture;

(b) a platen disposed in said housing;

(c) a print head disposed in said housing, said print head being movable from a first position spaced-apart from said platen to a second position adjacent said platen, said platen and said print head defining a clearance therebetween as said print head is in the first position; and (d) a cartridge insertable through the aperture and into said housing, said cartridge having an elongate neck portion sized to be received through the clearance for interference-free insertion of said cartridge into said housing, the neck portion defining a longitudinal axis therealong, said cartridge including:

(i) a supply spool for engaging a first end portion of a dye donor ribbon extending through the neck portion;

(ii) a take-up spool disposed in the neck portion for engaging a second end portion of the dye donor ribbon, said take-up spool having an elliptically-shaped transverse cross section defining a major axis thereof; and (e) a biasing mechanism associated with said take-up spool for biasing said take-up spool so that the major axis thereof is parallel with the longitudinal axis of the neck portion, said biasing mechanism including a spring member connected to said take-up spool.

6. The printer of claim 5, further comprising a movable arm connected to said print head for moving said print head from the first position to the second position.

7. The printer of claim 5, wherein said print head is a thermal print head.

8. A printer, comprising:

(a) a housing having a sidewall having an aperture;

(b) a print head disposed in said housing;

(c) a platen disposed in said housing, said platen being movable from a first position spaced-apart from said print head to a second position adjacent said print head, said platen and said print head defining a clearance therebetween as said platen is in the first position; and (d) a cartridge insertable through the aperture and into said housing, said cartridge having an elongate neck portion sized to be received through the clearance for interference-free insertion of said cartridge into said housing, the neck portion defining a longitudinal axis therealong, said cartridge including:

(i) a supply spool for engaging a first end portion of a dye donor ribbon extending through the neck portion;

(ii) a take-up spool disposed in the neck portion for engaging a second end portion of the dye donor ribbon, said take-up spool having an elliptically-shaped transverse cross section defining a major axis thereof; and (e) a biasing mechanism associated with said take-up spool for biasing said take-up spool so that the major axis thereof is parallel with the longitudinal axis of the neck portion.

9. The printer of claim 8, further comprising a pivotal arm connected to said platen for moving said platen from the first position to the second position.

10. A method of providing a printer, comprising the steps of:

(a) providing a platen;

(b) providing a print head associated with the platen, the print head being movable relative to the platen for defining a clearance therebetween; and (c) providing a cartridge having a neck portion sized to be received through the clearance, the step of providing a cartridge including the steps of:

(i) providing a first spool for engaging a first portion of a dye donor ribbon;

(ii) providing a second spool associated with the first spool for engaging a second portion of the dye donor ribbon, the second spool having an elliptically-shaped transverse cross section; and (d) providing a biasing mechanism associated with the take-up spool for biasing the take-up spool so that the major axis thereof is parallel with the longitudinal axis of the neck portion, the step of providing a biasing mechanism including the step of providing a spring member contacting the take-up spool.

11. A method of providing a printer, comprising the steps of:

(a) providing a housing having a sidewall having an aperture;

(b) providing a platen disposed in the housing;

(c) providing a print head disposed in the housing, the print head being movable from a first position spaced-apart from the platen to a second position adjacent the platen, the platen and the print head defining a clearance therebetween as the print head is in the first position; and (d) providing a cartridge insertable through the aperture and into the housing, the cartridge having an elongate neck portion sized to be received through the clearance for interference-free insertion of the cartridge into the housing, the neck portion defining a longitudinal axis therealong, said step of providing a cartridge including the steps of:

(i) providing a supply spool for engaging a first end portion of a dye donor ribbon extending through the neck portion;

(ii) providing a take-up spool disposed in the neck portion for engaging a second end portion of the dye donor ribbon, the take-up spool having an elliptically-shaped transverse cross section defining a major axis thereof; and (d) providing a biasing mechanism associated with the take-up spool for biasing the take-up spool so that the major axis thereof is parallel with the longitudinal axis of the neck portion, the step of providing a biasing mechanism including the step of providing a spring member contacting the take-up spool.

12. The method of claim 11, further comprising the step of providing a movable arm connected to the print head for moving the print head from the first position to the second position.

13. The method of claim 11, wherein the step of providing a print head comprises the step of providing a thermal print head.

14. A method of providing a printer, comprising the steps of:

(a) providing a housing having a sidewall having an aperture;

(b) providing a print head disposed in the housing;

(c) providing a platen disposed in the housing, the platen being movable from a first position spaced-apart from the print head to a second position adjacent the print head, the platen and the print head defining a clearance therebetween as the platen is in the first position; and (d) providing a cartridge insertable through the aperture and into the housing, the cartridge having an elongate neck portion sized to be received through the clearance for interference-free insertion of the cartridge into the housing, the neck portion defining a longitudinal axis therealong, the step of providing a cartridge including the steps of:

(i) providing a supply spool for engaging a first end portion of a dye donor ribbon extending through the neck portion;

(ii) providing a take-up spool disposed in the neck portion for engaging a second end portion of the dye donor ribbon, the take-up spool having an elliptically-shaped transverse cross section defining a major axis thereof; and (e) providing a biasing mechanism associated with the take-up spool for biasing the take-up spool so that the major axis thereof is parallel with the longitudinal axis of the neck portion.

15. The method of claim 14, further comprising the step of providing a pivotal arm connected to the platen for moving the platen from the first position to the second position.

* * * * *